US005533869A

United States Patent [19]

Garrison et al.

[11] Patent Number: 5,533,869

[45] Date of Patent: Jul. 9, 1996

[54] POWER TOOL EXHAUST COOLING SYSTEM

[75] Inventors: Daniel A. Garrison; Jeffrey S. Franke, both of Charlotte, N.C.

[73] Assignee: Homelite, Inc., Charlotte, N.C.

[21] Appl. No.: 345,480

[22] Filed: Nov. 28, 1994

[51] Int. Cl.[6] ..... F04B 53/16; F01P 7/02

[52] U.S. Cl. ..... 417/234; 417/312; 123/41.65

[58] Field of Search ..... 417/234, 380, 417/312; 15/405, 413, 326; 60/320; 123/41.7, 41.63, 41.64, 41.65, 198 E

[56] References Cited

U.S. PATENT DOCUMENTS

| | | | |
|---|---|---|---|
| 4,223,419 | 9/1980 | Sato et al. | 15/327 C |
| 4,332,220 | 6/1982 | Itzrodt | 123/41.65 |
| 4,370,855 | 2/1983 | Tuggle | 60/317 |
| 4,644,606 | 2/1987 | Luerken et al. | 15/405 |
| 4,658,778 | 4/1987 | Gamoh et al. | 123/195 C |
| 4,674,146 | 6/1987 | Tuggle et al. | 15/330 |
| 4,809,502 | 3/1989 | Iida et al. | 60/316 |
| 4,872,308 | 10/1989 | Nagai et al. | 60/316 |
| 4,913,112 | 4/1990 | Iida | 123/41.65 |
| 5,011,058 | 4/1991 | Sapp et al. | 224/261 |
| 5,035,586 | 7/1991 | Sadler et al. | 417/363 |
| 5,052,073 | 10/1991 | Iida | 15/327.5 |
| 5,080,048 | 1/1992 | Kudo | 123/41.64 |
| 5,176,303 | 1/1993 | Franke | 224/261 |
| 5,231,956 | 8/1993 | Lux et al. | 123/41.65 |
| 5,233,946 | 8/1993 | Yamami | 123/41.65 |
| 5,269,665 | 12/1993 | Sadler et al. | 417/234 |
| 5,367,988 | 11/1994 | Collins | 123/41.65 |

*Primary Examiner*—Peter Korytnyk
*Attorney, Agent, or Firm*—Perman & Green

[57] ABSTRACT

A housing for a power tool has an integral molded air channel or duct. The air channel surrounds the flywheel rotor of the power tool engine. The air channel is able to capture air pushed by the spinning flywheel rotor and direct the air directly towards the muffler of the engine. The air mixes with the exhaust gases from the muffler to reduce the temperature of the gases as they leave the housing.

26 Claims, 4 Drawing Sheets

POWER TOOL EXHAUST COOLING SYSTEM

BACKGROUND OF THE INVENTION

1. Field of the Invention

The present invention relates to power tools and, more particularly, to a system for cooling exhaust gases generated by the engine of the power tool.

2. Prior Art

U.S. Pat. No. 5,035,586 discloses a portable leaf blower/vacuum that uses the flywheel of its engine to direct cooling air through the interior of the interior fan housing, across the cylinder, and across the muffler. The air is mixed with the hot muffler discharge gas when it exits the muffler guard. U.S. Pat. No. 4,674,146 discloses a blower that also mixes cooling air with engine exhaust. U.S. Pat. No. 4,370,855 discloses a flywheel of a chain saw located close to its muffler. U.S. Pat. No. 4,809,502 discloses diverting air from a blower impeller by means of a tube to mix with exhaust gases. U.S. Pat. No. 5,080,048 discloses an exhaust vent from a muffler that opens into a blower volute casing.

SUMMARY OF THE INVENTION

In accordance with one embodiment of the present invention in a housing for a power tool, the power tool having an internal combustion engine with a flywheel rotor and a muffler, the improvement comprising the housing including a first integral inwardly-extending air channeling wall section located at an interior area of the housing that is suitably sized and shaped to surround a substantial portion of a side perimeter of the rotor and form a channeling airflow path from the rotor directly towards an outlet of the muffler. In accordance with another embodiment of the present invention, a power tool is provided comprising an internal combustion engine and a housing connected to the engine. The internal combustion engine has a flywheel rotor and a muffler. The housing has a first inwardly-projecting air channel wall section. The first air channel wall section surrounds a portion of a side perimeter of the flywheel rotor and forms an air flow conduit from the rotor towards the muffler for delivering substantially all of the air pushed by the flywheel rotor towards the muffler.

In accordance with another embodiment of the present invention, a leaf blower is provided comprising an internal combustion engine, a fan, and a housing. The internal combustion engine has a muffler and a flywheel rotor. The fan is operably connected to the engine. The housing is connected to the engine and surrounds, at least partially, the fan and the engine. The housing includes a first housing member with an integral inwardly projecting first air channel wall section. The first air channel wall section surrounds a substantial portion of a side perimeter of the flywheel rotor and forms an air flow path from the rotor directly towards the muffler. Substantially all of the air pushed by the flywheel rotor is pushed towards the muffler.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
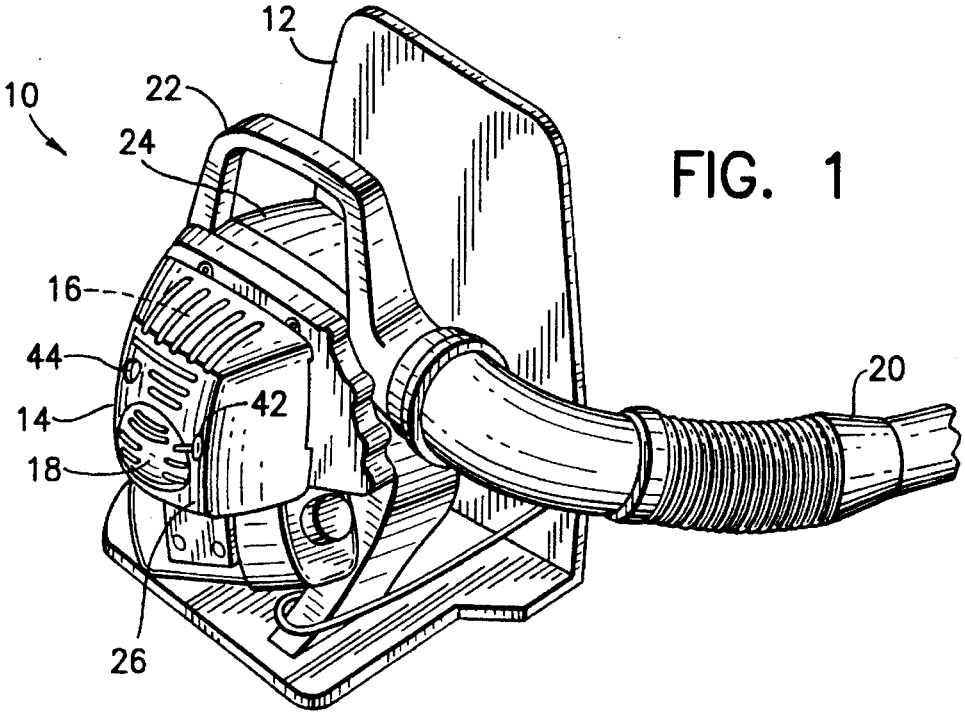
FIG. 1 is a partial rear, side and top perspective view of a leaf blower and back pack assembly incorporating features of the present invention.

Referring to FIG. 1, there is shown a partial perspective view of a leaf blower and back pack assembly 10 incorporating features of the present invention. Although the features of the present invention will be described with reference to the embodiments shown in the drawings, it should be understood that features of the present invention can be embodied in many different alternate embodiments. In addition, any suitable size, shape or type of elements or materials could be used.

The assembly 10 generally comprises a back pack 12 and a blower unit 14. Any suitable type of back pack could be provided, such as the back packs described in U.S. Pat. Nos. 5,011,058 and 5,176,303. However, in alternate embodiments, a back pack need not be provided. The blower unit 14 generally comprises an internal combustion engine 16, a housing 18, a discharge tube 20, and an impeller or fan blade (not shown) operably connected to the engine 16. The engine 16 rotates the fan blade to push air into and through the discharge tube 20. The blower unit 14 can be removed from the back pack 12 and converted into a vacuum, as is known in the art, by use of a vacuum accessory kit (not shown). The housing 18 includes a carry handle 22, a fan blade housing section 24, and a rear cover 26. The fan blade housing section 24 has an air inlet (not shown) for the fan blade. In alternate embodiments, the housing 18 could be made of more members or fewer members. The rear cover 26, in the embodiment shown, is attached to the rest of the housing to partially enclose the engine 16.

Figure 3:
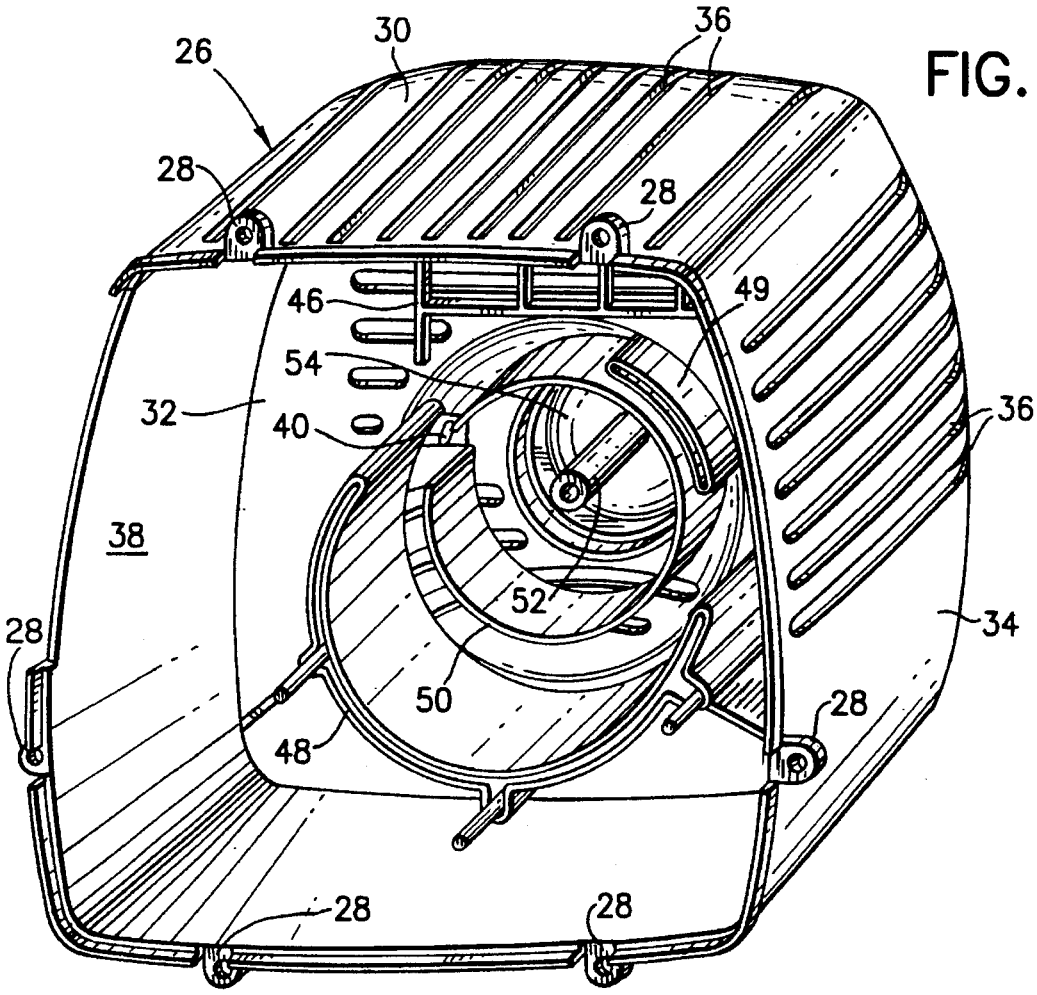
FIG. 3 is a front, side and top perspective view of the housing cover shown in FIG. 2.
Figure 2:
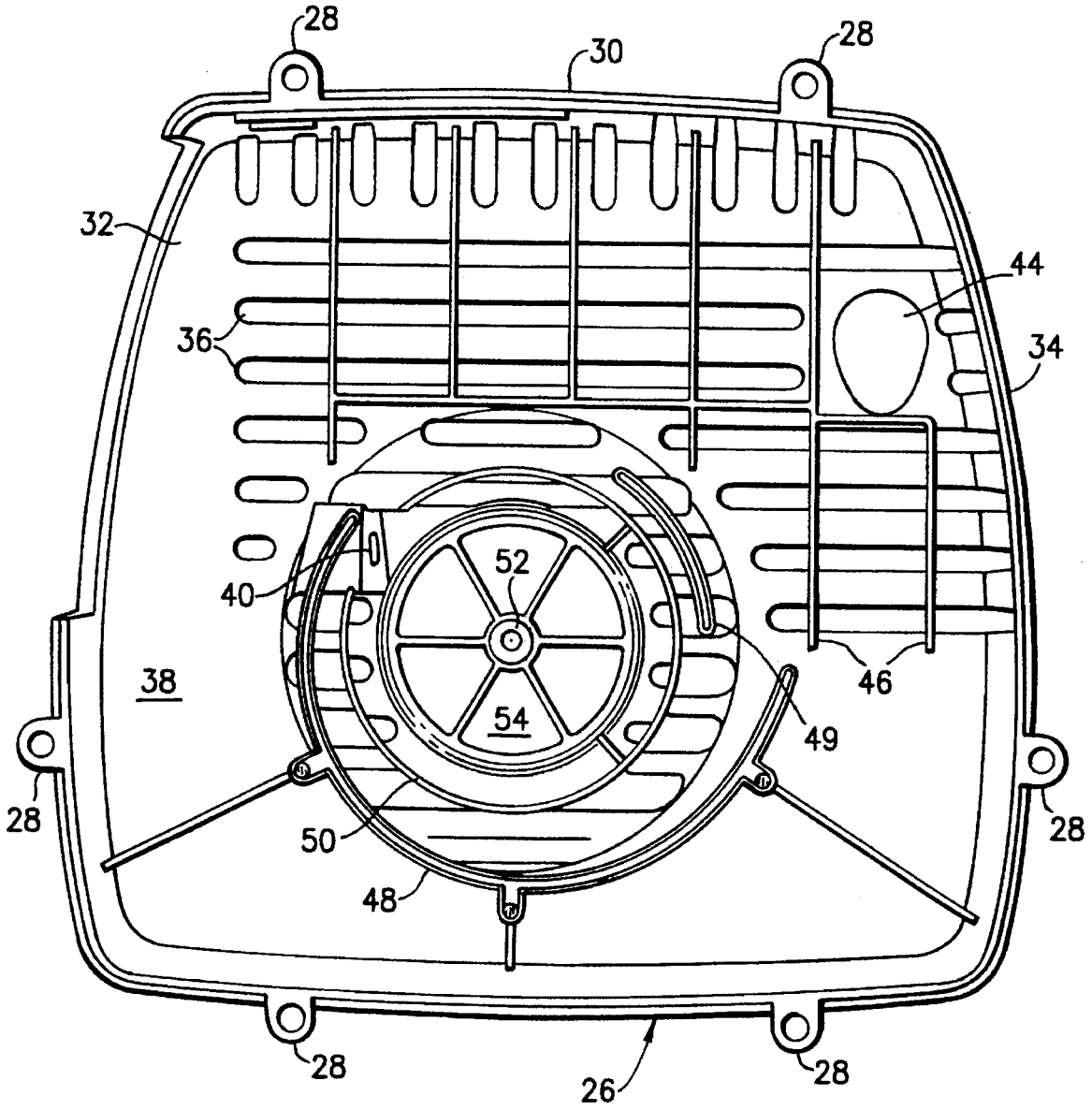
FIG. 2 is a front plan view of a rear housing cover of the blower shown in FIG. 1.

Referring also to FIGS. 2 and 3, the rear cover 26, in this embodiment, is comprised of a single one-piece molded polymer or plastic member. The cover 26 has a general box-like shape with an open front end having mounting bosses 28. The mounting bosses 28 are provided to fixedly attach the cover 26 to the rest of the housing by suitable fasteners, such as screws. The top wall 30, back wall 32, and a side wall 34 have air slots 36 for air to move into and out of the interior 38 of the cover 26. The back wall 32 also has a hole 40 for the starter cord (not shown) attached to the starter handle 42 (see FIG. 1) to operably pass through the cover 26. In addition, the cover 26 has another hole 44 located at an outlet to the engine's muffler for exhaust gases from the muffler to exit from inside the cover 26. Located on the inside of the cover 26 are structural strengthening ribs 46. Projecting inwardly from the back wall 32 are three walls 48, 49, 50 that form an air channeling section. This air channeling section forms a channeling air flow path as further described below. An inwardly projecting post 52 is also provided to prevent the back wall 32 from being accidently pushed in. The post 52 could also be used to mount the recoil starter (not shown) to the cover 26 in area 54.

The air channeling section formed by the walls 48, 49, 50 is provided to interact with the flywheel rotor 56 (see FIG.

Figure 4:
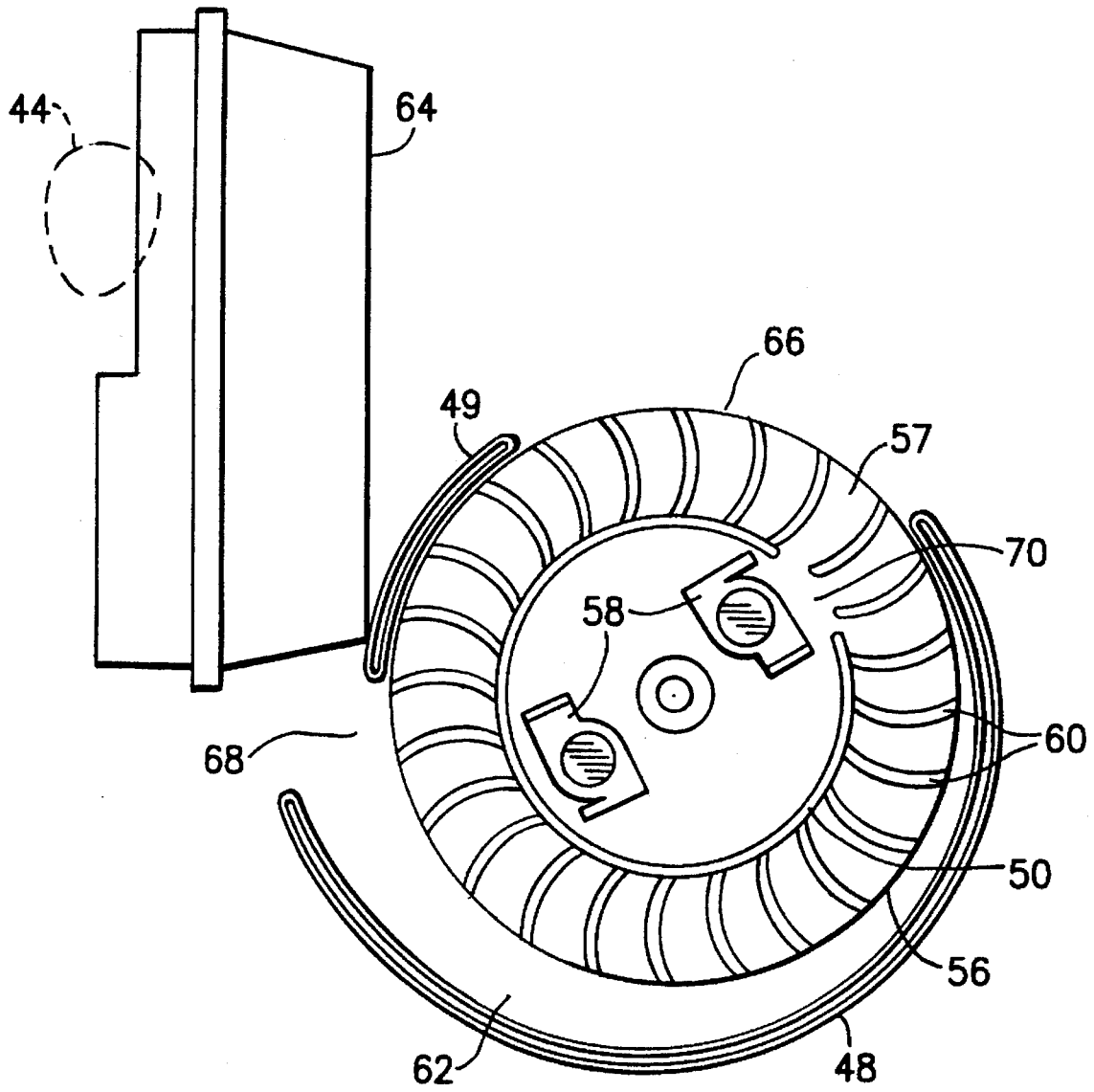
FIG. 4 is a schematic view of a portion of the housing cover, the flywheel of the engine, and the muffler of the engine in the blower shown in FIG. 1.

4) of the engine 16. Referring also to FIG. 4, the rotor 56 has starter pawls 58 and fins 60 on its top surface 57. In the embodiment shown, the top surface 57 is actually facing a rearward direction towards the back wall 32 of the cover 26. The rotor 56 is fixed to the shaft of the engine and has a magnet (not shown) as is known in the art. The outer walls 48, 49 of the air channeling section form a first integral inwardly extending air channeling wall section. The outer Walls 48, 49 are suitably sized and shaped to surround a substantial portion of a side perimeter of the rotor 56 or, in other words, substantially entirely surrounds the side perimeter of the rotor. Both outer walls 48, 49 have arcuate shapes. The smaller outer wall 49 has a substantially constant radius of curvature and faces the larger outer wall 48. The larger outer wall 48 has a changing radius of curvature. As shown in FIG. 4, the outer walls 48, 49 and rotor 56 combine to form a flow path or conduit 62 from the rotor 56 directly to the muffler 64 of the engine. The changing radius curvature of the larger outer wall 48 forms the conduit 62 with a general volute shape. An open space 66 is provided between the ends of the outer walls 48, 49 for locating the magneto section (not shown) of the engine proximate the side of the rotor 56. The magneto section (not shown) substantially closes the gap between the ends of the outer walls 48, 49 at the open space 66. Thus, the side perimeter of rotor 56 is substantially enclosed. An outlet 68 is provided, however, at the muffler 64.

The inner wall 50 forms a second wall section. The inner wall 50 is located inside an inner perimeter of the fins 60. The inner wall 50 is inwardly projecting and generally circular. A notch 70 is provided in the inner wall 50 to allow the starter cord (not shown) to operably pass therethrough. The inner wall 50 establishes an inner barrier for air flow to enhance air movement by the fins 60 of the rotor 56. Vortexes or turbulence at the area of the rotor 56 inside the inner rim of the fins 60 is prevented from significantly interfering with air flow movement. With this arrangement, substantially all of the air pushed by the fins 60 of the rotor 56 is pushed through the conduit 62 for delivery towards the muffler 64.

The purpose of directing substantially all of the air pushed by the rotor 56 towards the muffler 64 is to reduce the temperature of exhaust gases from the engine at the point in which the exhaust gases leave the blower unit 14. Because the air from the rotor 56 is directed directly towards the muffler 64 and its outlet, the air both cools the housing of the muffler 64 and mixes with the exhaust gases as the gases pass from the outlet muffler 64 to the hole 44 in the rear cover 26 and out of the unit 14. In addition, the cooling air also cools the area of the cover 26 surrounding the hole 44. By using substantially all of the air from the rotor 56, and integrating the air flow conduit with the rear cover, the present invention allows the unit 14 to pass governmental hot gas temperature standards without the use of an additional attachment or guard. This can obviously reduce the manufacturing cost of the unit 14 while meeting newer governmental hot gas standards.

Figure 5:
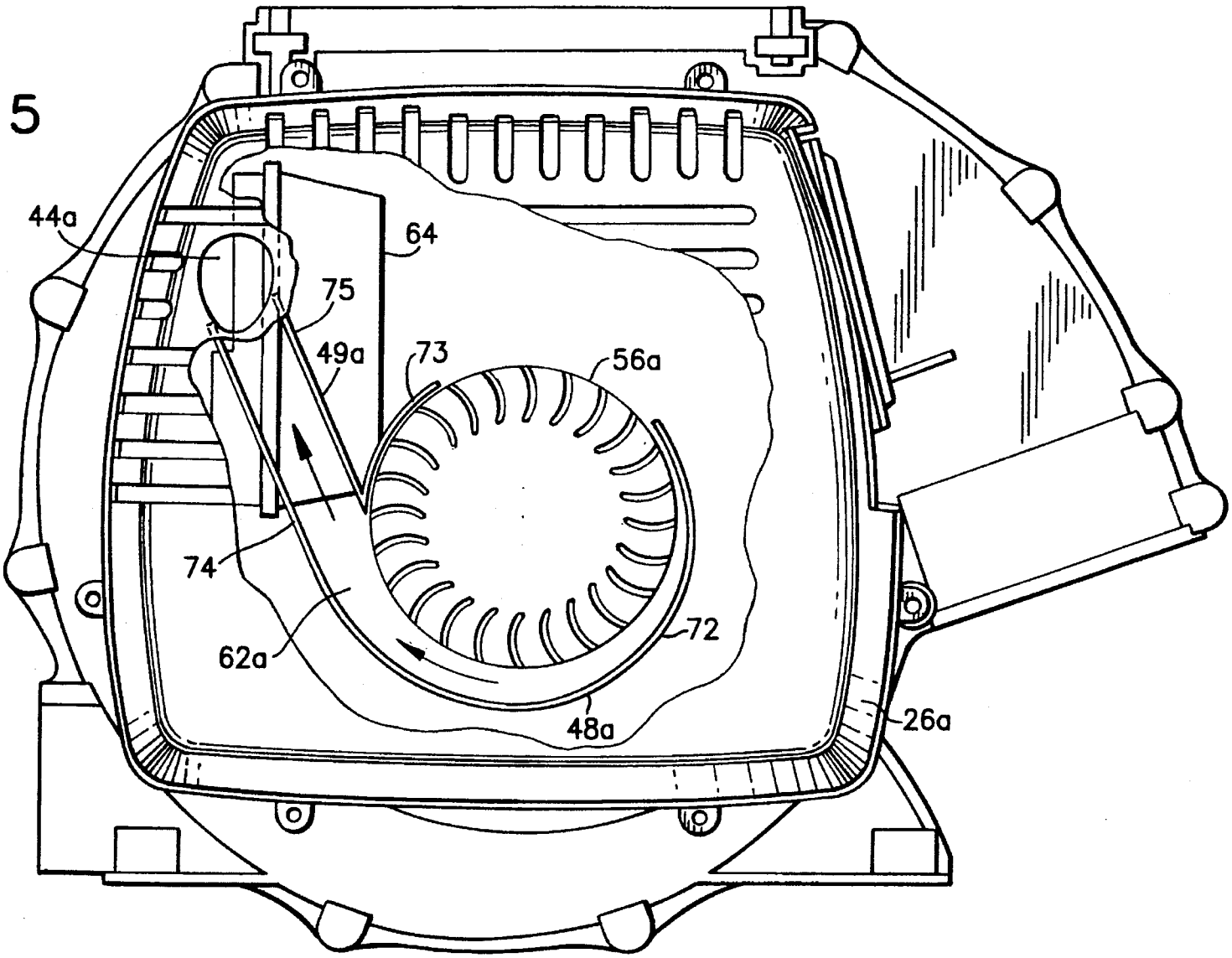
FIG. 5 is a schematic rear view of an alternate embodiment of the invention with a cut-away section showing the muffler, flywheel, and air channel.

Referring now also to FIG. 5, a rear view with a cut away section of an alternate embodiment of the present invention is shown. In this embodiment the two outer walls 48*a*, 49*a* of the rear cover 26*a* that constitute the first air channeling wall section include both arcuate portions 72 and 73 and, straight portions 74 and 75. The arcuate portions 72, 73 are substantially similar to the walls 48, 49 of the embodiment, shown in FIGS. 1–4. The straight portions 74 and 75 extend from the arcuate portions 72, 73, respectively, directly to the hole 44*a*. With this embodiment, the cooling air from the rotor 56*a* is guided in the flow path 62*a* all the way to the hole 44*a* for a more concentrated cooling air mixture with the exhaust gases. From this embodiment, it should be evident to a person skilled in the art that various different shapes of air channeling sections could be provided. The walls that extend inwardly from the back wall 32 could be separate members that are attached to the cover 26 rather than integral with the rest of the cover. The cover 26 could be made from multiple members. In alternate embodiments, rather than the cover 26 being a back cover, it could be located at any suitable location; wherever the flywheel rotor is located. The present invention could also be used with an engine that did not have a muffler; the air channeling section directing air from the rotor 56 towards the exhaust outlet of the engine. The present invention could also be used in other types of power tools having internal combustion engines including other types of lawn and garden power tools.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a housing for a power tool, the power tool having an internal combustion engine with a flywheel rotor and a muffler, the improvement comprising:

the housing including a first integral inwardly extending air channeling wall section located within an interior area of the housing that is suitably sized and shaped to surround a substantial portion of a side perimeter of the rotor and form a channeling air flow path, the path including a straight and direct section extending from the rotor to an outlet of the muffler.

2. A housing as in claim 1 wherein the first wall section has two walls with arcuate shapes.

3. A housing as in claim 2 wherein a first one of the walls has a changing radius curvature and a second one of the walls faces the first wall and has a substantially constant radius of curvature.

4. A housing as in claim 2 wherein at least one of the walls has an arcuate portion and a relatively straight portion.

5. A housing as in claim 1 wherein the housing further includes an inwardly extending generally circular second wall section suitably sized and shaped to be located proximate an inner perimeter of fins on the flywheel rotor.

6. A power tool comprising:

an internal combustion engine having a flywheel rotor and a muffler; and a housing connected to the engine, the housing having a molded one-piece member with a first inwardly projecting air channel wall section integral therewith, the first air channel wall section located within an interior area of the housing and surrounding a portion of a side perimeter of the flywheel rotor and forming an air flow conduit from the rotor towards the muffler for delivering substantially all of the air pushed by the flywheel rotor towards the muffler.

7. A power tool as in claim 6 wherein the one-piece member has a box-like shape with air apertures therethrough.

8. A power tool as in claim 6 wherein the first air channel wall section includes first and second walls with arcuate shapes.

9. A power tool as in claim 8 wherein the first wall has a portion with a changing radius curvature to form the air flow conduit between the first wall and the flywheel rotor with a general volute shape.

10. A power tool as in claim 6 wherein the housing further comprises an inwardly projecting generally circular second wall section located above a top surface of the flywheel rotor proximate an inner perimeter of fins on the flywheel rotor.

11. A leaf blower comprising:

an internal combustion engine with a muffler and a flywheel rotor;

a fan connected to the engine; and a housing connected to the engine and surrounding, at least partially, the fan and the engine, the housing including a first one-piece housing member having a general box-like shape with an integral inwardly projecting first air channel wall section located within an interior area of the housing, the first air channel wall section surrounding a substantial portion of a side perimeter of the flywheel rotor and forming an air flow path from the rotor directly towards the muffler, wherein substantially all of the air pushed by the flywheel rotor is pushed towards the muffler.

12. A leaf blower as in claim 11 wherein the first housing member further includes an integral generally circular second wall section located inside an inner perimeter of fins on the flywheel rotor.

13. A leaf blower as in claim 11 wherein the first air channel wall section has two arcuate shaped walls.

14. A leaf blower as in claim 13 wherein a first one of the walls has an increasing radius of curvature, wherein the air flow path has a volute shape between the flywheel rotor and the first wall.

15. A leaf blower as in claim 14 wherein a second one of the walls has a relatively constant radius of curvature and is located on an opposite side of the flywheel rotor from the first wall.

16. A leaf blower as in claim 15 wherein two spaces are provided between ends of the first and second walls.

17. In a power tool having an internal combustion engine with a flywheel rotor and a housing, the improvement comprising:

the housing including a molded one-piece housing member with an integral inwardly extending air channeling wall section located within an interior area of the housing, that is suitably sized and shaped to substantially entirely surround a side perimeter of the rotor and form a channeling air flow path from the rotor.

18. A power tool as in claim 17 wherein the housing member has a general box-like shape.

19. A power tool as in claim 17 wherein the wall forms a direct and straight path to an area where exhaust gas exit the housing.

20. A power tool as in claim 17 wherein the wall forms a direct and straight path at a member connected to an exhaust gas outlet of the engine.

21. A power tool as in claim 20 wherein the member is a muffler of the engine.

22. A housing as in claim 17 wherein the wall section has two walls with arcuate shapes, a first one of the walls has a portion with a changing radius curvature and a second one of the walls faces the first wall and has a substantially constant radius of curvature.

23. A power tool comprising:

an internal combustion engine having a flywheel rotor; and a housing connected to the engine, the housing having a first one-piece housing member with a first inwardly projecting air channel wall section located within an interior area of the housing, the first air channel wall section surrounding a portion of a side perimeter of the flywheel rotor and forming a portion of an air flow conduit from the rotor towards an element connected to an exhaust gas outlet of the engine for delivering substantially all of the air pushed by the flywheel rotor directly towards the element.

24. A power tool as in claim 23 wherein the wall section substantially entirely surrounds a side perimeter of the rotor.

25. A power tool as in claim 23 wherein the housing member has a general box-like shape with apertures therethrough.

26. An apparatus having an internal combustion engine with a flywheel rotor and a housing, the improvement comprising:

the housing having a first one-piece housing member with two inwardly projecting air channel walls located within an interior area of the housing, the air channel walls surrounding a majority of a side perimeter of the flywheel rotor and forming a portion of an air flow conduit from the rotor towards an element connected to an exhaust gas outlet of the engine for delivering substantially all of the air pushed by the flywheel rotor in a straight and direct path directly towards the element.

* * * * *